US005646645A

United States Patent [19]

Saegusa

[11] Patent Number: 5,646,645

[45] Date of Patent: Jul. 8, 1997

[54] FLASHING LCD DISPLAY SYSTEM

[75] Inventor: Takashi Saegusa, Kawasaki, Japan

[73] Assignee: Nikon Corporation, Tokyo, Japan

[21] Appl. No.: 585,688

[22] Filed: Jan. 16, 1996

Related U.S. Application Data

[62] Division of Ser. No. 361,540, Dec. 22, 1994, Pat. No. 5,546,100.

[30] Foreign Application Priority Data

Dec. 22, 1993 [JP] Japan ..... 5-345578

[51] Int. Cl.[6] ..... G09G 3/36

[52] U.S. Cl. ..... 345/101

[58] Field of Search ..... 345/101

[56] References Cited

U.S. PATENT DOCUMENTS

| | | | |
|---|---|---|---|
| 4,556,877 | 12/1985 | Kumagai et al. | 345/101 |
| 4,812,837 | 3/1989 | Shiraishi et al. . | |
| 4,951,226 | 8/1990 | Sasaki . | |
| 5,153,575 | 10/1992 | Watts, Jr. et al. . | |
| 5,245,325 | 9/1993 | Terada | 345/101 |
| 5,251,293 | 10/1993 | Ishii et al. . | |

FOREIGN PATENT DOCUMENTS

| | | | |
|---|---|---|---|
| 54-043762 | 4/1979 | Japan | 345/101 |
| 54-106000 | 8/1979 | Japan | 345/101 |

*Primary Examiner*—Jeffery Brier

[57] ABSTRACT

A dot matrix LCD system able to provide a flashing effect having a control unit to output a signal indicative of a symbol to be displayed and a reversal signal indicative of whether the symbol is to be displayed in the reverse. A first memory unit connected to the control unit stores the symbol to be displayed, and a second memory unit connected to the control unit stores an indication of whether the symbol is to be displayed in the reverse. A character generator connected to the first memory unit generates a pattern of dots based on the indication stored in the first memory unit, while a pattern memory unit connected to the character generator stores the pattern of dots. An LCD display unit having a plurality of display dots, is driven by a driver to illuminate the display dots, corresponding to the pattern. A temperature detection circuit detects ambient temperature. A reversal operation unit connected between the pattern memory unit and the driver transmits the pattern from the pattern memory unit to the driver. The reversal operation unit reverses the pattern based on the indication stored in the second memory unit and reverses the pattern at a rate which is dependent upon the ambient temperature detected.

4 Claims, 5 Drawing Sheets

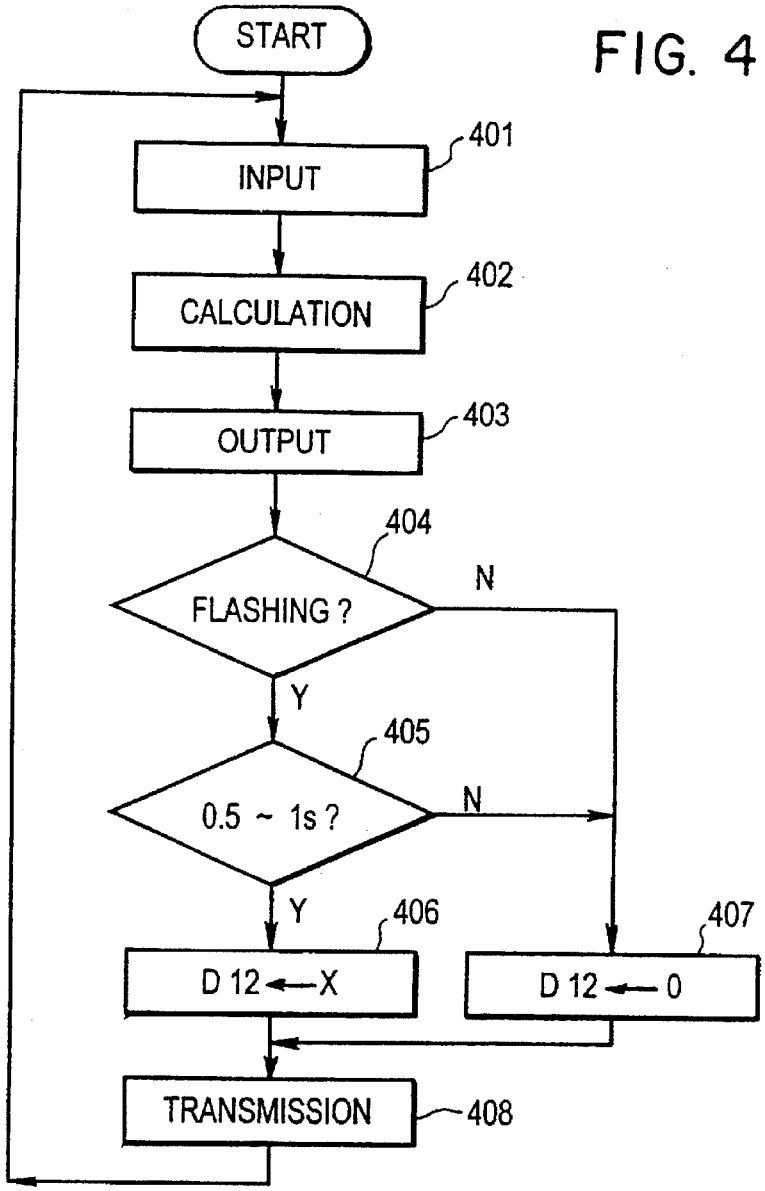
FIG. 4
FIG. 5(A)
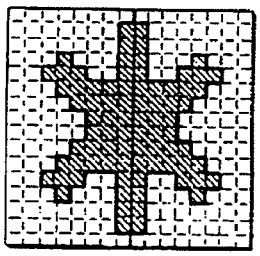
FIG. 5(B)
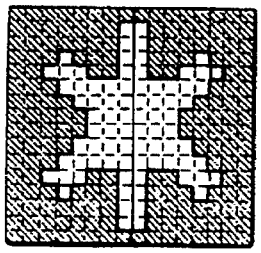

FLASHING LCD DISPLAY SYSTEM

This application is a division of application Ser. No. 08/361,540, filed Dec. 22, 1994, now U.S. Pat. No. 5,546,100.

BACKGROUND OF THE INVENTION

1. Field of the Invention

The present invention relates to a LCD display system and, more particularly, to a dot matrix LCD display system in which a flashing dot display pattern is developed from data generated based on input information.

2. Description of the Related Art

Heretofore, dot matrix liquid crystal display (LCD) systems were comprised of three functional units: a column driver, a common driver, and a character generator. These functions were either provided on three separate chips or integrated into one chip. In such a dot matrix LCD display system, not only are the control commands, for switching the dot matrix LCD on and off, to achieve a flashing effect complicated, but the dot matrix LCD display system itself is complicated.

SUMMARY OF THE INVENTION

Accordingly, it is an object of the present invention to provide a dot matrix LCD display system which allows the switching of a dot matrix LCD on and off to be controlled without using complicated control commands.

It is another object of the present invention to provide a less complex dot matrix LCD system.

It is yet another object of the present invention to provide a simple LCD system which provides a flashing effect usable with a simple command by alternatively displaying a normal pattern and a reversed pattern.

Objects of the present invention are achieved by a dot matrix LCD display system comprising a first data generation unit to generate first through Nth dot display data based on input information, a second data generation unit to generate data for control use concerning reversed display or normal display relating to the first through Nth dot display data, a first memory unit to store the first through Nth dot display data, a second memory unit to store the data for control use, a pattern data development unit to develop pattern data of the first through Nth dot display, a pattern memory unit to store the pattern data, a reversal operation unit for reversal of the pattern data based on the data for control use, and a drive unit to drive a first through Nth dot matrix LCD in accordance with the pattern data which is modified by the reversal operation unit.

Objects of the present invention are also achieved by a method for driving a dot matrix LCD display system comprising generating first through Nth dot display data based on input information, storing the display data in a first memory unit, generating data for control use indicating whether the dot display data is to be reverse displayed or normally displayed, storing the data for control use in a second memory unit, developing a dot display pattern based on the first through Nth dot display pattern in a pattern memory unit reversing the dot display pattern if data for control use indicates the dot display data is to be reversed, and driving the first through Nth for matrix LCDs in accordance with the dot display pattern.

Objects of the present invention are further achieved by a dot matrix LCD display system comprising a LCD display unit having a plurality of display dots forming at least one display region, a character generator to generate a pattern of dots needed to display a symbol in the at least one display region, a reversal operation unit connected to the character generator to reverse the pattern of dots in response to a reversal control signal, and a drive unit connected to the reversal operation unit to cause the plurality of display dots to light up corresponding to the pattern of dots.

Objects of the present invention are also achieved by a dot matrix LCD system comprising a control unit to output a signal indicative of a symbol to be displayed and a reversal signal indicative of whether the symbol is to be displayed in the reverse, a first memory unit connected to the control unit to store the symbol to be displayed, a second memory unit connected to the control unit to store an indication of whether the symbol is to be displayed in the reverse, a character generator connected to the first memory unit to generate a pattern of dots based on the indication stored in the first memory unit, a pattern memory unit connected to the character generator to store the pattern of dots, a LCD display unit having a plurality of display dots, a driver connected to the LCD display unit to control the illumination of the display dots, and a reversal operation unit connected between the pattern memory unit and the driver to transmit the pattern from the pattern memory to the driver, the reversal operation unit reversing the pattern based on the indication stored in the second memory unit.

Objects of the present invention are further achieved by a method for driving a dot matrix LCD display comprising memorizing symbol data indicative of a symbol to be displayed on the dot matrix LCD display, memorizing reversal data indicative of whether the symbol should be displayed in reverse, generating dot matrix display pattern data based on the symbol data, if the reversal data indicates that the symbol is to be displayed in reverse reversing the dot matrix display pattern data, and driving the dot matrix LCD display in accordance with the dot matrix display pattern data.

BRIEF DESCRIPTION OF THE DRAWINGS

FIG. 4 is a flow chart showing the operation of a dot matrix LCD display system in accordance with the preferred embodiment of the present invention.

FIGS. 5(A) and 5(B) are diagrams showing an example of a normal display and a reverse display.

DESCRIPTION OF THE PREFERRED EMBODIMENT

Figure 1:
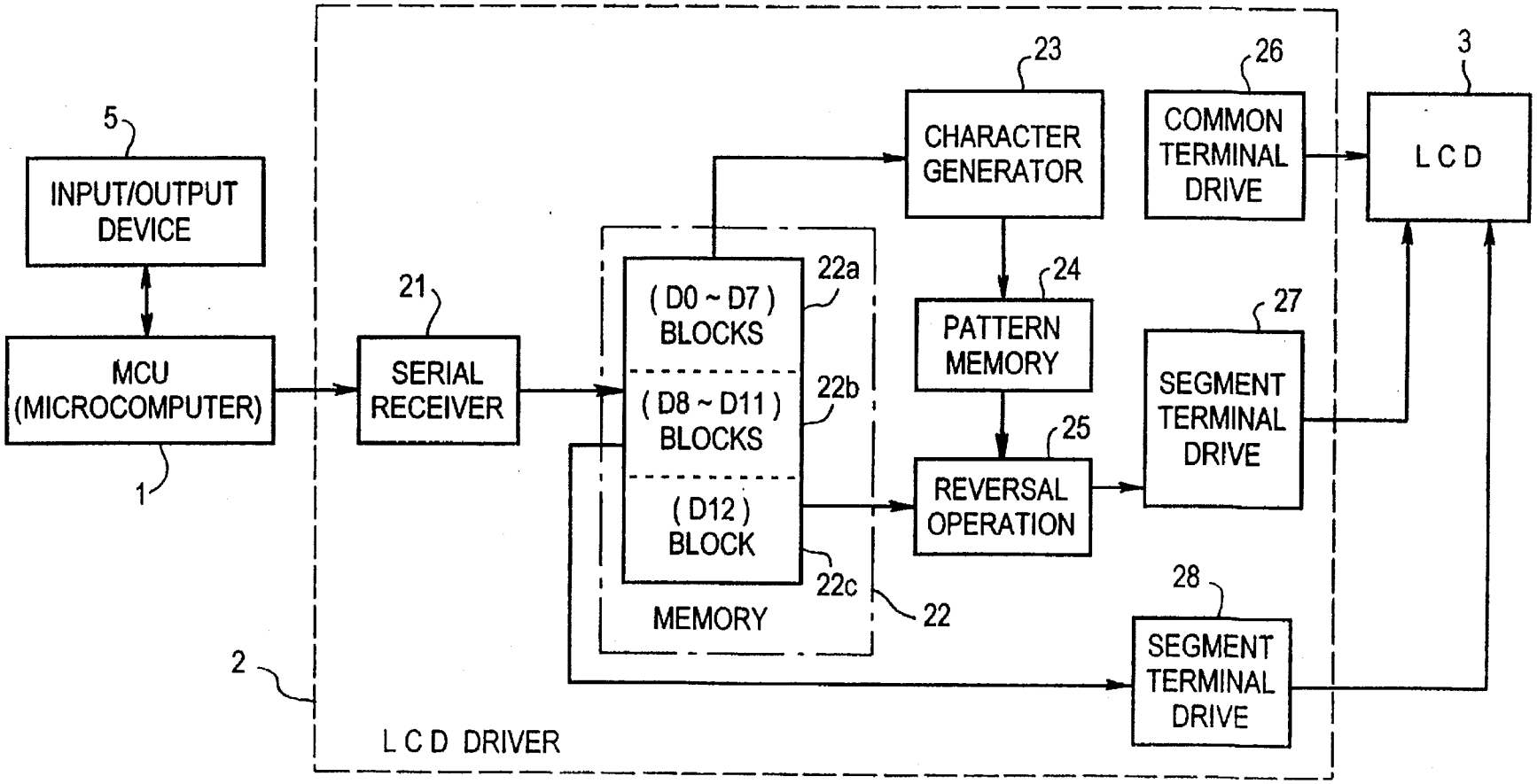
FIG. 1 is a block diagram of a dot matrix LCD display system in accordance with the preferred embodiment of the present invention.

FIG. 1 is a block diagram of a dot matrix LCD display system in accordance with the preferred embodiment of the present invention. The dot matrix LCD display system generally comprises a MCU 1, a LCD driver 2, and a LCD display element 3.

Figure 2:
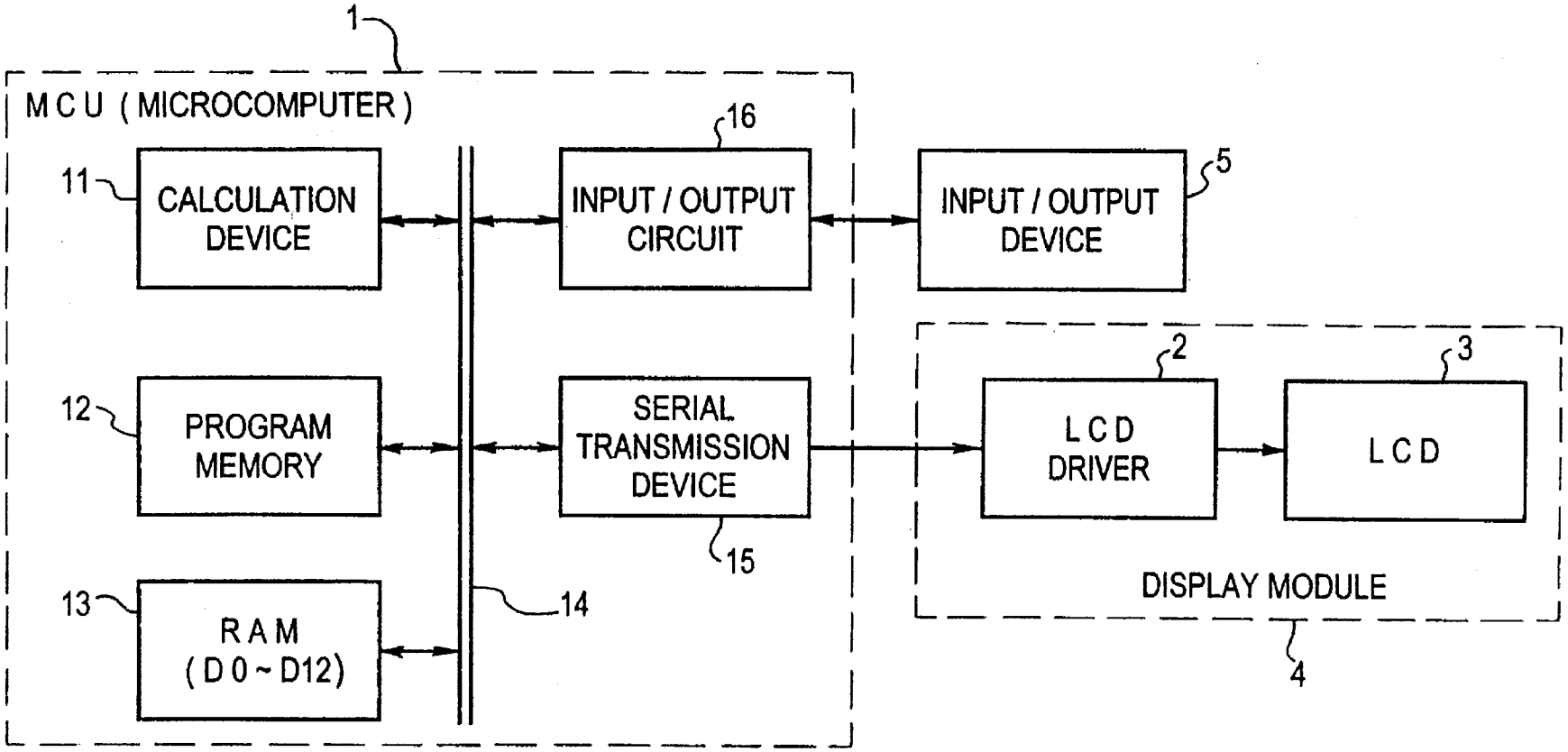
FIG. 2 is block diagram showing the dot matrix LCD display system in accordance with the preferred embodiment of the present invention.

FIG. 2 is a block diagram showing the MCU 1, which preferably comprises a microcomputer having a calculation device 11, a program memory 12, a RAM 13, a bus 14, a serial transmission device 15 and an input/output circuit 16. The MCU I is connected to the LCD driver 2 and the LCD display element 3 may be mounted as part of an integrated display module 4. The MCU I is further connected to an input/output device 5 through which necessary information is input and output.

Figure 3:
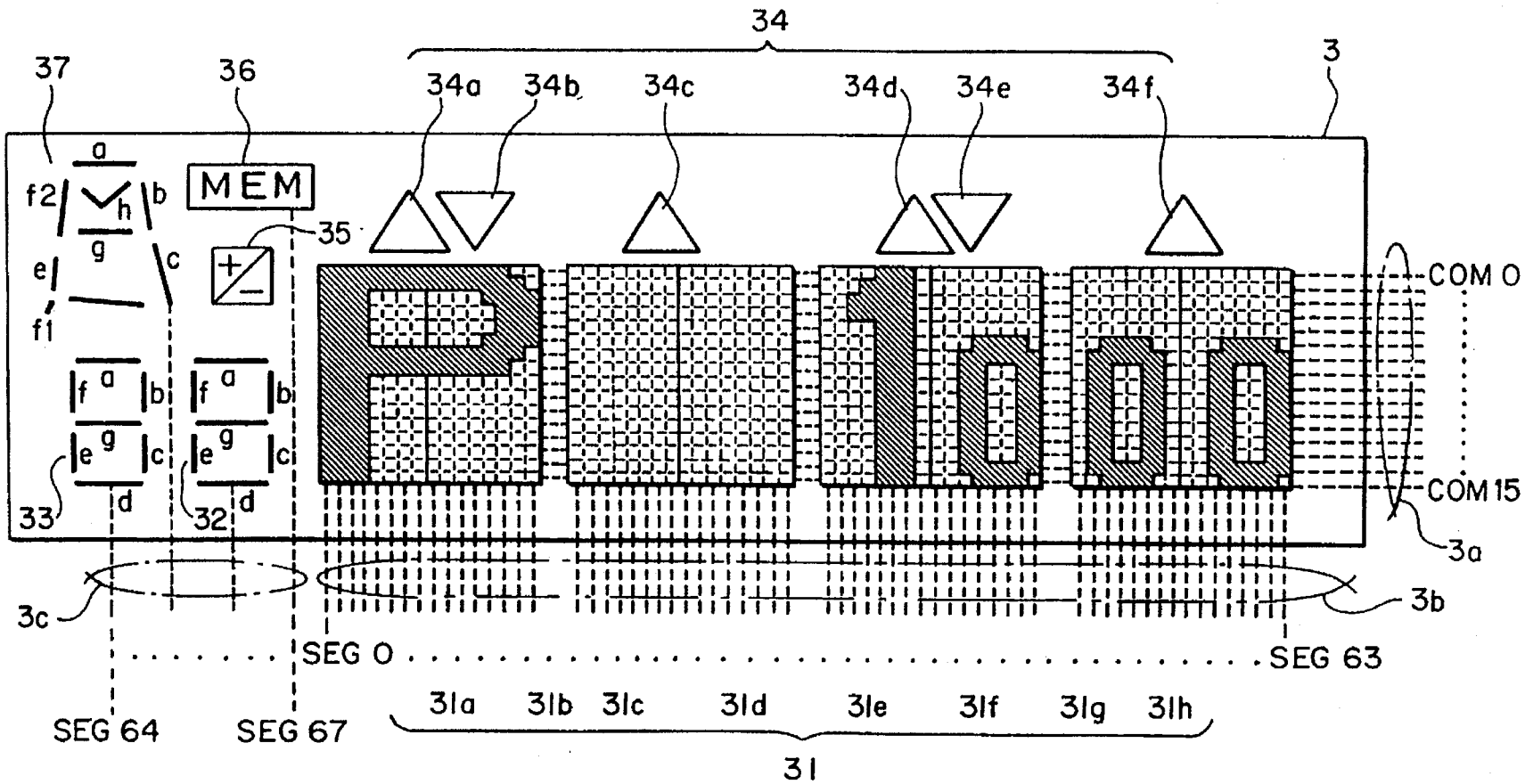
FIG. 3 is a block diagram showing the dot matrix LCD display in accordance with the preferred embodiment of the present invention.

Referring to FIG. 3, the LCD display unit 3 comprises a dot matrix LCD display unit 31 and several individual display units 32–37. As set forth in the preferred embodiment, the LCD display unit 3 is particularly suited for the display of information in a camera.

The dot matrix LCD display unit 31 comprises dot matrix regions 31*a*–31*h*, each measuring 16 dots high×8 dots wide. Each dot matrix region 31*a*–31*h* may be used to display one character, for example, as shown in FIG. 3 by dot matrix regions 31*e*–31*h* which collectively display "1000". When each 16×8 dot matrix region displays one character, it is considered to be in a half angle display mode. However, according to the preferred embodiment, dot matrix regions 31*a* and 31*b*, 31*c* and 31*d*, 31*e* and 31*f*, and 31*g* and 31*h* form adjacent pairs having intervals there between. By using each pair to display a single character, for example as shown in FIG. 3 by dot matrix regions 31 a and 31*b* which collectively display a "P", a whole angle display of 16×16 dots is possible.

The eight dot matrix regions 31*a*–31*h* in the dot matrix LCD display unit 31 are driven at 1/16 duty, by sixteen common terminals 3*a*(COM0–COM15) and sixty-four segment terminals 3*b*(SEG0–SEG63).

The individual display units 32 and 33 are well known 7-segment display units, and respectively comprise seven segments a–g. The individual display units 34*a*–34*f* are segment display units which display triangles above the dot matrix regions 31*a*–31*h*. The individual display unit 35 is a 1-segment display unit to indicate that exposure has been corrected. The individual display unit 38 is a 1-segment display unit to indicate that data has been stored in a user memory (not shown). The individual display unit 37 is a segment display to indicate the exposure control mode by forming the characters "P", "S", "A" or "M", and consists of nine segments a–h. The segments f1 and f2 are electrically connected so that they are simultaneously lighted.

The individual display units 32–37 comprise a total of thirty-two segments. In the preferred embodiment, the individual display units 32–37 share several common terminals 3*a* with the dot matrix LCD unit 31, and as such, are also driven at 1/16 duty. The common terminals 3*a* shared by the dot matrix LCD display unit 31 and the individual segments 32–37 may be limited to the lowest 2, but depending on the configuration of the wiring, more may be used. In the preferred embodiment, as shown in Table 1, eight common terminals (COM0–COM7) are used by both the dot matrix LCD unit 31 and the individual display units 32–37. The terminals 3*c*, comprising four terminals SEG64–SEG67, in conjunction with the common terminals COM0–COM7, drive the individual display units 32–37. The individual display units 32–37, for control purposes, are equivalent to the dot matrix LCD display unit.

TABLE 1

| | COM 7 | COM 6 | COM 5 | COM 4 | COM 3 | COM 2 | COM 1 | COM 0 |
|---|---|---|---|---|---|---|---|---|
| SEG 64 | | 32 g | 32 f | 32 e | 32 d | 32 c | 32 b | 32 a |
| SEG 65 | | 33 g | 33 f | 33 e | 33 d | 33 c | 33 b | 33 a |
| SEG 66 | 36 | 35 | 34 f | 34 e | 34 d | 34 c | 34 b | 33 a |
| SEG 67 | 37 b | 37 g | 37 f | 37 e | 37 d | 37 c | 37 b | 37 a |

When driving the segments terminals 3*a* which are common (COM0–COM7) to the individual display units 32–37 and the dot matrix LCD display unit 31, there is a possibility of decreasing the performance of the dot matrix LCD display unit 31; however this is offset by providing a simpler overall circuit.

The LCD driver 2, as shown in FIG. 1, comprises internal components 21–28, preferably fabricated in one chip. A serial receiver 21 receives data serially transmitted from the MCU 1. The RAM 13 as shown in FIG. 2 for the MCU 1 holds data to be transmitted as 13-byte commands, as set forth in Table 2, to the serial receiver 21.

TABLE 2

| MCU Data | COM-MAND | CONTENTS | Driver Block |
|---|---|---|---|
| D0 | #1 byte | Data for dot matrix region 31a | 22a |
| D1 | #2 | Data for dot matrix region 31b | |
| D2 | #3 | Data for dot matrix region 31c | |
| D3 | #4 | Data for dot matrix region 31d | |
| D4 | #5 | Data for dot matrix region 31e | |
| D5 | #6 | Data for dot matrix region 31f | |
| D6 | #7 | Data for dot matrix region 31g | |
| D7 | #8 | Data for dot matrix region 31h | |
| D8 | #9 | Data for the individual display 32 | 22b |
| D9 | #10 | Data for the individual display 33 | |
| D10 | #11 | Data for the individual displays 34, 35, and 36 | |
| D11 | #12 | Data for the individual display 37 (a–h) | |
| D12 | #13 | Data for dot LCD reversal control | 22c |

A memory unit 22 stores the data transmitted to the serial receiving device 21 in three blocks 22*a*–22*b*, as set forth in Table 2. Bytes D0–D7, stored in the block 22*a* of the memory unit 22, indicates what symbol is to be displayed on the dot matrix regions 31*a*–31*h*. Bytes D8–D11, stored in block 22*b* of the memory unit 22, indicates which segments of the individual display units 32–37 are to be turned on. Byte D12 (data for control use), stored in block 22*c* of the memory unit 22, indicates which of the respective displays of the dot matrix regions 31*a*–31*h* is to be displayed alternatively in a normal mode and a reversed mode creating a flashing effect.

A character generator 23 develops the data D0, (one byte each) into an 16×8 dot display pattern data, and transmits this to a pattern memory unit 24. The character generator 23 generates a 16×8 dot display pattern data for each byte D1–D7 until a dot display pattern data of 16×8×8 bits is stored in the pattern memory unit 24. As is apparent, the character generator 23 is able to generate 256 different 16×8 patterns from 1 byte of data.

A reversal operation unit 25 either reverses or leaves unchanged the dot display pattern stored in the pattern memory unit 24, based on the byte D12 stored in block 22*c* of the memory unit 22. The reversal operation unit 25 transmits the resultant data to the segment terminal drive 27. In the preferred embodiment, if all of the bits of byte D12, stored in block 22*c*, are "0", the dot display pattern stored in the pattern memory unit 24 is left unchanged. If any of the bits of the byte D12, stored in block 22*c*, are set to "1", the display region 31*a*–31*h* in the dot display pattern data in the pattern memory unit 24, corresponding to the bit or bits set to "1", is reversed. The reversed pattern is then transmitted to the segment terminal drive 27.

The segment terminal drive 27 is connected to the segment terminals 3*b* (SEG0–SEG63) of the dot matrix LCD display unit 31 of the LCD 3 and drives, i.e. lights and extinguishes, the segments of the LCD display unit 31 according to the dot display pattern data which is transmitted from the reversal operation unit 25.

A common terminal drive 26, drives the common terminals 3*a* (COM0–COM15) of the dot matrix LCD display unit 31 and the segment display units 32–37. A segment terminal drive 28 drives the segment terminal 3*c* (SEG64–SEG67) to light or extinguish the segment display units 32–37. Each segment of the individual display units 32–37 are driven in accordance with the bits of the data D8–D11 in block 22*b* of the memory unit 22.

FIG. 4 is a flow chart showing the operational sequence of the MCU 1. After the power supply is switched on and the unit is reset, the process begins at step 401. In step 401 of FIG. 4, input data is received from the input/output device 5 via the input/output circuit 16 as shown in FIG. 2. Predetermined regions of the RAM 13 are set corresponding to the input data. Next, in step 402, calculations are performed based on the input data, and bits 0–7 of an X register (not shown) are set according to the result of these calculations. According to the bits 0–7 in the X register, the dot matrix regions 31*a*–31*h* are either set to flash or provide a constant display, in block 22*c* of memory 22.

In step 403, the MCU 1 performs an output process by outputting via the input/output circuit 16 to the input/output device 5. Thereafter, in step 404, it is determined whether the data contained in the X register indicates that a dot matrix region is supposed to flash. In the preferred embodiment, if the bit in the X register corresponding to a dot matrix region 31*a*–31*h* is set to "0", the dot matrix region 31*a*–31*h* provides a constant display. In this case, the routine proceeds to step 407. If any of the dot matrix LCDs (31*a*–31*h*) is controlled to flash, because the corresponding bit in the block 22*c* is set to "1", and thus the X register becomes a numerical value of 1 or more, "flashing" control is desired and the process proceeds to step 405.

In step 405, a one second timer is checked and if the one second timer is in the range of 0–0.5 sec, the routine proceeds to step 407. If the one second timer is in the range 0.5–1 sec, the routine proceeds to step 406. In step 406, the contents of the X register are transmitted as byte D12 to the RAM 13. In step 407, each bit of byte D12 is transmitted to the RAM 13 as "0". Thereafter, in step 408, the bytes D0–D12 are transmitted as commands.

In the case where flashing is not desired, because the routine proceeds by step 401→402→403→404→407, each bit of byte D12 becomes "0". Therefore, when the bytes D0–D12 are transmitted in step 408, the byte D12 is sent to block 22*c* of the LCD driver 2 and the reversal operation is not performed by the reversal operation unit 25. The dot display pattern data, developed by the character generator 23, is unchanged and the dot matrix regions 31*a*–31*h* display a normal character or symbol.

On the other hand, where "flashing" is desired, and when the 1 second timer is between 0–0.5 sec, operation proceeds by the steps: 401→402→403→404→405→407, and each bit of byte D12 becomes "0". Therefore, when the bytes D0–D12 are transmitted in step 408, byte D12, is set to "0" in block 22*c* of the LCD driver 2 and the reversal operation is not performed by the reversal operation unit 25. The dot display pattern data developed by the character generator 23 is left unchanged, and the dot matrix regions 31*a*–31*h* display normal character(s). Thereafter, when the 1 second timer is between 0.5–1 sec, operation proceeds by the steps: 401→402→403→404→405→406. The byte D12, corresponding to the dot matrix regions (31*a*–31*h*) which have flashing control set, becomes a "1". In this manner, when bytes D0–D12 are transmitted in step 408, the dot matrix regions (31*a*–31*h*) which correspond to the set bits are transmitted as reversed symbols to the segment terminal drive 27.

FIG. 5 is a diagram showing a normal dot matrix pattern and the same pattern reversed. The dot display pattern, i.e. an "*", is developed by the character generator 23 and stored in the pattern memory unit 24, and is displayed by means of the segment terminal drive unit 27. Every 0.5 seconds, the patterns shown in FIG. 5(A) and FIG. 5(B) are alternatively displayed for 0.5 second intervals, thereby creating a flashing display of 1 second period. Moreover, the process as shown in FIG. 4 is assumed to occur every 100 ms or less; however, the reversal process itself of step 408 is carried out only when the display data has changed.

When the temperature of the LCD display system is low, for example below −10° C., the response of the LCD slows. In such a case, a display time of 0.5 seconds is not long enough to give an adequate flashing effect.

Figure 6:
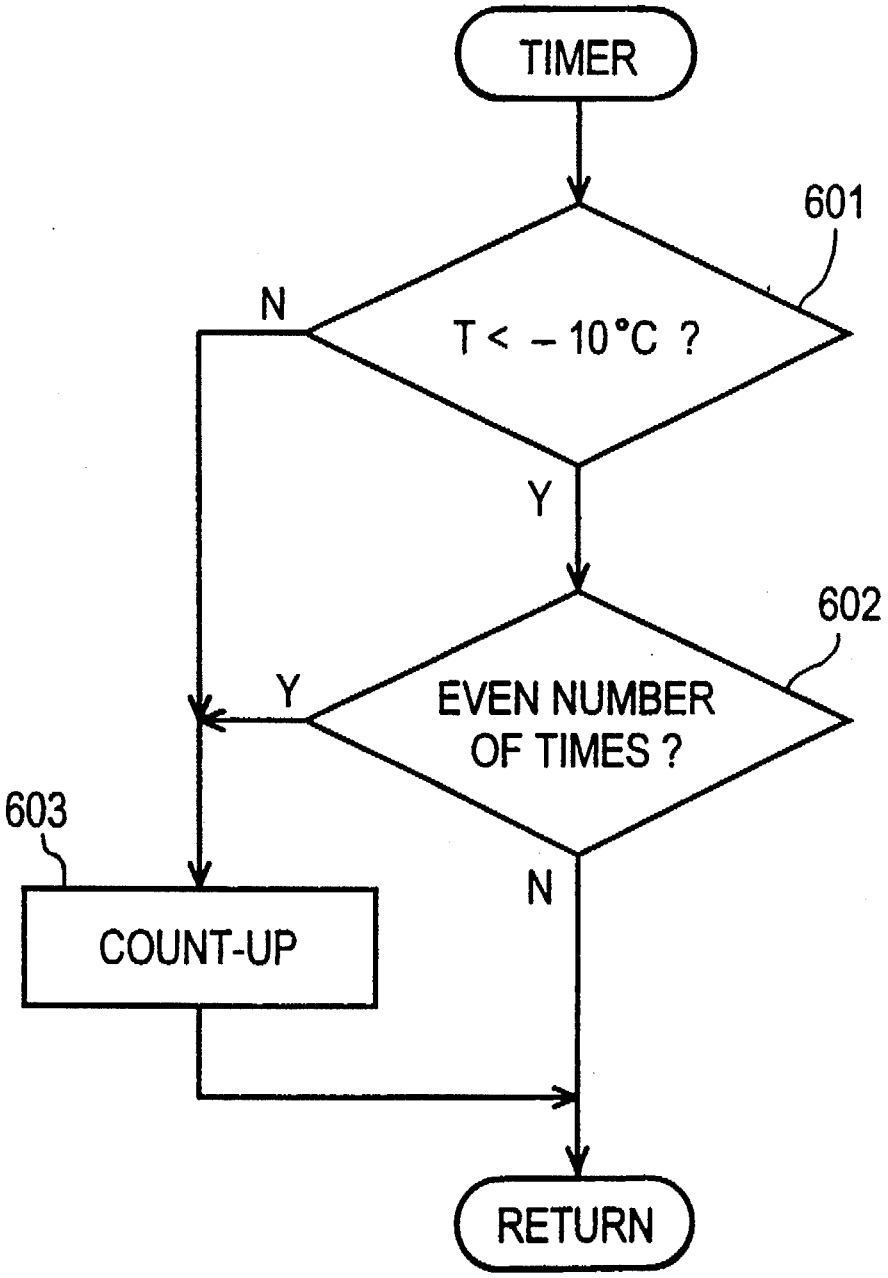
FIG. 6 is a flow chart showing the operation of an MCU in a dot matrix LCD display system in accordance with the preferred embodiment of the present invention.

FIG. 6 is a flow chart of an interrupt process in the MCU 1. The MCU 1, while processing the main routine as shown in FIG. 4, may apply an interrupt every 1 ms, switching the process to the process shown in FIG. 6. In step 601, an output of a temperature sensor (not shown), which is input in step 401 of FIG. 4, is tested. If the temperature "T" is above −10° C., the routine proceeds to step 603, and if below −10° C., the routine proceeds to step 602. In step 602, it is determined whether there has been an even number of interrupts. If there has been an even number of interrupts, the routine proceeds to step 603, and if there has been an odd number of interrupts, the routine returns unchanged to the interrupted process of FIG. 4. If the temperature is less than −10° C., a count-up of the one second timer is performed. This increases the flashing period, as given in the process of FIG. 4, to 1 sec for the normal and reversed display, thus giving a two second flashing display. When the temperature is above −10° C., a count-up is not performed.

By means of the present invention as described hereinabove, data is formed to control the reverse display or non-reverse display of dot display data based on input information. This data for control use is transmitted to a second memory unit and stored. Dot display pattern data, both reversed and non-reversed, are stored in the pattern memory unit, based on the data for control use, and first through Nth dot matrix LCDs are driven according to this reversed/non-reversed dot display pattern.

Although a preferred embodiment of the present invention has been shown and described, it would be appreciated by those skilled in the art that changes may be made in the embodiment without departing from the principles and spirit of the invention, the scope which is defined in the claims and their equivalents. For example, while the individual display units have been described with reference to LCD technology, they may be embodied by LED technology. Further, while the specific LCD display system disclosed herein is for use in a camera, one of ordinary skilled in the art will recognize that the system is applicable for other operating environments, including calculators, clocks and watches.

What is claimed is:

1. A dot matrix display system comprising:

an LCD display unit;

a temperature detection circuit which detects an ambient temperature; and a drive unit adapted to cause said LCD unit to create a rapid flashing effect by alternately presenting a normal pattern and a reverse pattern, each pattern being displayed for a period of time based on the ambient temperature detected by said temperature detection circuit.

2. A dot matrix display system comprising:

an LCD display unit;

temperature detection means for detecting an ambient temperature; and a drive means for causing said LCD display unit to create a rapid flashing effect by alternately presenting a normal pattern and a reverse pattern, each pattern being displayed for a period of time determined by the ambient temperature.

3. An LCD display system comprising:

a temperature detection circuit which detects an ambient temperature; and a drive unit adapted to cause said LCD display unit to create a rapid flashing effect by alternately presenting a normal pattern and a reverse pattern, each pattern being displayed for a period of time based on the ambient temperature detected by said temperature detection circuit.

4. An LCD display system comprising:

temperature detection means for detecting an ambient temperature; and a drive means for causing said LCD display system to create a rapid flashing effect by alternately presenting a normal pattern and a reverse pattern, each pattern being displayed for a period of time determined by the ambient temperature.

* * * * *